US012590745B2

(12) United States Patent
Kray et al.

(10) Patent No.: US 12,590,745 B2
(45) Date of Patent: Mar. 31, 2026

(54) METHODS AND APPARATUS FOR ARTIFICIAL BIRD MANUFACTURING IN IMPACT TESTING

(71) Applicant: General Electric Company, Schenectady, NY (US)

(72) Inventors: Nicholas Joseph Kray, West Chester, OH (US); Thomas J. Brinck, Evendale, OH (US); Tod W. Davis, West Chester, OH (US); Chad M. Harbert, Evendale, OH (US)

(73) Assignee: General Electric Company, Evendale, OH (US)

( * ) Notice: Subject to any disclaimer, the term of this patent is extended or adjusted under 35 U.S.C. 154(b) by 381 days.

(21) Appl. No.: 17/240,531

(22) Filed: Apr. 26, 2021

(65) Prior Publication Data

US 2022/0341641 A1 Oct. 27, 2022

(51) Int. Cl.
*F25C 1/04* (2018.01)

(52) U.S. Cl.
CPC ..... *F25C 1/04* (2013.01)

(58) Field of Classification Search
CPC ..... B64F 5/10; F25C 1/04; F25C 5/14; F42B 12/72; F42B 12/74; G01M 15/14; G01M 7/08
See application file for complete search history.

(56) References Cited

U.S. PATENT DOCUMENTS

| | | | | |
|---|---|---|---|---|
| 405,690 | A * | 6/1889 | Ball | F42B 14/064 86/52 |
| 4,389,794 | A | 6/1983 | Bitterly | |
| 6,769,287 | B2 | 8/2004 | Stewart et al. | |
| 6,807,717 | B2 | 10/2004 | Daehn | |
| 10,620,099 | B2 | 4/2020 | Bressan et al. | |
| 2006/0089075 | A1 * | 4/2006 | Windt | A63H 27/005 124/64 |

(Continued)

FOREIGN PATENT DOCUMENTS

| | | | |
|---|---|---|---|
| CN | 1177099 | A * | 3/1998 |
| CN | 103940567 | A | 7/2014 |

(Continued)

OTHER PUBLICATIONS

Allaeys et al., Characterization of real and substitute birds through experimental and numerical analysis of momentum, average impact force and residual energy in bird strike on three rigid targets: A flat plate, a wedge and a splitter, 2017 (Year: 2017).*

(Continued)

*Primary Examiner* — Xiao S Zhao
*Assistant Examiner* — Victoria Bartlett
(74) *Attorney, Agent, or Firm* — McGarry Bair PC

(57) ABSTRACT

Methods and apparatus for artificial bird manufacturing in impact testing is described herein. An apparatus to generate an artificial bird for impact testing includes a mold generator to form a mold based on a bird class identification, a mold filler to fill the mold with a first layer of crushed ice and a second layer of crushed ice, a compressor to compress an ice (Continued)

surface of at least one of the first layer or the second layer of the crushed ice to form indentations on the ice surface, and a freezer to re-freeze the crushed ice layers inside the mold to form an artificial bird.

14 Claims, 5 Drawing Sheets

(56) References Cited

U.S. PATENT DOCUMENTS

| | | | | |
|---|---|---|---|---|
| 2011/0178780 | A1 | 7/2011 | Clark et al. | |
| 2011/0192314 | A1* | 8/2011 | Ritt | F42B 12/76 102/501 |
| 2017/0350799 | A1* | 12/2017 | Bressan | F42B 12/36 |
| 2018/0356179 | A1* | 12/2018 | Matson | F41B 11/87 |
| 2019/0056206 | A1 | 2/2019 | Fukushige et al. | |
| 2019/0170419 | A1 | 6/2019 | Guyon | |

FOREIGN PATENT DOCUMENTS

| | | | | | |
|---|---|---|---|---|---|
| CN | 105938509 | A | | 9/2016 | |
| CN | 109060471 | A | * | 12/2018 | G01N 1/286 |
| CN | 111928549 | B | * | 11/2020 | F25C 1/04 |
| CN | 112100903 | A | | 12/2020 | |
| DE | 102018109613 | | | 10/2019 | |
| EP | 2172734 | | | 4/2010 | |
| EP | 3032214 | | | 6/2016 | |
| EP | 3491305 | | | 6/2019 | |
| EP | 3623728 | | | 3/2020 | |
| FR | 2979429 | | | 3/2013 | |
| FR | 2997499 | A1 | | 5/2014 | |
| FR | 3028309 | A1 | | 5/2016 | |
| JP | 2010090890 | | | 4/2010 | |
| WO | WO-03060397 | A1 | * | 7/2003 | E01H 4/00 |
| WO | 2015019649 | | | 2/2015 | |
| WO | 2019201398 | | | 10/2019 | |

OTHER PUBLICATIONS

English Translation of CN109060471 (Year: 2018).*

Megu ID et al: "FE analysis of geometry effects of an artificial bird striking an aeroengine fan blade", International Journal of Impact Engineering, Pergamon, GB, vol. 35, No. 6, Feb. 11, 2008 (Feb. 11, 2008), pp. 487-498, XP022475906, ISSN: 0734-743X, DOI: 10.1016/J.IJIMPENG.2007.04.008.

Richard Budger: "The Development of a Substitute Artificialbird by the International Birdstrike Research Group for Use in Aircraft Component Testing", Apr. 17, 2000 (Apr. 17, 2000) Internet:URL:http://www.int-birdstrike.org/Amsterdam_Papers/IBSC25 WPIE3.pdf, 5 pages.

European Patent Office "European extended search report," issued in connection with EP patent application No. 22165206.8 mailed on Sep. 26, 2022, 14 pages.

European Patent Office "Communication pursuant to Rule 69 EPC," issued in connection with EP patent application No. 22165206.8 mailed on Nov. 11, 2022, 2 pages.

The State Intellectual Property Office of People's Republic of China, "First Office Action," issued in connection with Chinese Patent Application No. 202210441087.0, dated Feb. 29, 2024, 14 pages. [English translation Included].

Yin Jing, Chen Wei, "Cut model of soft objects impacting cascades", Journal of Nanjing University of Aeronautics and Astronautics, No. 04, Aug. 30, 1992 (Aug. 30, 1992), pp. 403-408, 6 pages. [English abstract included].

The State Intellectual Property Office of People's Republic of China, "Notification of Grant Patent Right for Invention," issued in connection with Chinese Patent Application No. 202210441087.0, dated Aug. 1, 2024, 3 pages. [English Translation Included].

* cited by examiner

METHODS AND APPARATUS FOR ARTIFICIAL BIRD MANUFACTURING IN IMPACT TESTING

FIELD OF THE DISCLOSURE

This disclosure relates generally to aircraft component testing and, more particularly, to methods and apparatus for artificial bird manufacturing in impact testing.

BACKGROUND

Turbine engines are some of the most widely used power generating technologies. Gas turbines are an example of an internal combustion engine that uses a burning air-fuel mixture to produce hot gases that spin the turbine, thereby generating power. Application of gas turbines can be found in aircraft, trains, ships, electrical generators, gas compressors, and pumps. For example, modern aircraft rely on a variety of gas turbine engines as part of a propulsion system to generate thrust, including a turbojet, a turbofan, a turboprop, and an afterburning turbojet. Such engines include a combustion section, a compressor section, a turbine section, and an inlet, providing high power output with a high thermal efficiency.

Component testing of aircraft-based gas turbines includes evaluation of engine response to a bird strike. Bird strikes can lead to permanent deformations, sudden decreases of thrust, and/or potential engine failure. Engine design accounting for unavoidable bird strikes can be used to reduce the severity of potential damage resulting from bird ingestion (e.g., passage of a bird into the engine inlet or impact with engine structure). Artificial birds can be developed to simulate the mass, shape, density, and/or impact effect(s) of birds during ingestion testing. However, reproducing the physical properties of real birds (e.g., including different bird species) can be challenging and lack in consistency. Accordingly, a consistent and reproducible method of artificial bird manufacturing for use in testing aircraft components would be welcomed in the technology.

Figure 1A:
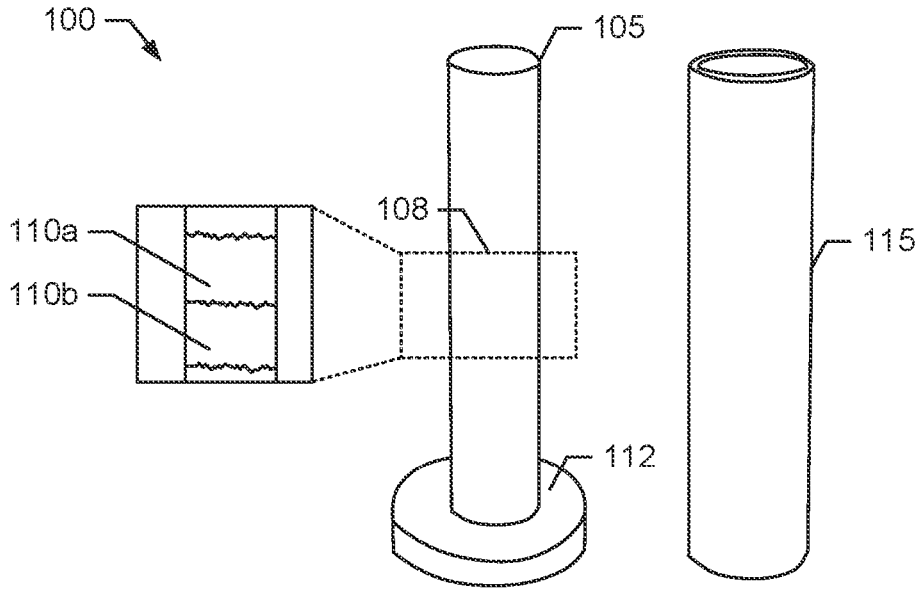
FIG. 1A illustrates an example artificial bird assembly formed with layered ice using an example mold, based on apparatus and methods disclosed herein.

The figures are not to scale. Instead, the thickness of the layers or regions may be enlarged in the drawings. In general, the same reference numbers will be used throughout the drawing(s) and accompanying written description to refer to the same or like parts. As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Stating that any part is in "contact" with another part means that there is no intermediate part between the two parts. Although the figures show layers and regions with clean lines and boundaries, some or all of these lines and/or boundaries may be idealized. In reality, the boundaries and/or lines may be unobservable, blended, and/or irregular.

BRIEF SUMMARY

Methods and apparatus for artificial bird manufacturing in impact testing are disclosed.

Certain examples include an apparatus to generate an artificial bird for impact testing. The example apparatus includes a mold generator to form a mold based on a bird class identification, a mold filler to fill the mold with a first layer of crushed ice and a second layer of crushed ice, and a compressor to compress an ice surface of at least one of the first layer or the second layer of the crushed ice to form indentations on the ice surface. The example apparatus includes a freezer to re-freeze the crushed ice layers inside the mold to form an artificial bird.

Certain examples provide a method to generate an artificial bird for impact testing. The example method includes forming a mold based on a bird class identification, filling the mold with a first layer of crushed ice and a second layer of crushed ice, and compressing an ice surface of at least one of the first layer or the second layer of the crushed ice to form indentations on the ice surface. The example method includes re-freezing the crushed ice layers inside the mold to form an artificial bird.

Certain examples provide a method of manufacturing an artificial bird for impact testing. The example method includes crushing an amount of ice corresponding to a desired artificial bird weight, positioning a first layer of crushed ice inside a mold, compressing a top of the first layer of the crushed ice, and moistening the compressed top of the first layer. The example method includes positioning a second layer of crushed ice on the first layer.

DETAILED DESCRIPTION

Bird ingestion during aircraft operation can occur during any phase of flight, but is most common during take-off, initial climb, approach, and/or landing. While small aircraft are more likely to experience structural damage (e.g., damage to control surfaces, penetration of windscreens, etc.), larger aircraft experience engine-based bird ingestion, with a potential partial or complete loss of control and/or erroneous instrument reading(s) resulting from loss of flight instrument function due to the impact effects. Any part of the front engine of an aircraft can be struck by a bird, including inlet mounted components (e.g., inlet sensors), nose cone, spinner on the fan or compressor rotor, an engine protection device (e.g., inlet barrier filter), engine inlet guide vane assembly, and/or fan or compressor blades. In some examples, first stage rotating blades (e.g., first exposed stages of any fan or compressor rotor) are susceptible to a bird ingestion event and/or a bird strike. As such, engines require design and structurally and/or operationally tolerant construction to withstand a bird ingestion event. In some examples, assessing an engine's ability to withstand a bird ingestion and/or impact can be based on testing of various bird sizes, potential velocities, target location(s), and/or rotor speed(s). Artificial birds can be developed to simulate the mass, shape, density, and/or impact effects of various bird species.

Maximum impact damage to the engine as a result of bird ingestion can be determined using a critical impact parameter (CIP), represented as a function of bird mass, bird velocity, fan or rotor speed, bird impact or aiming location, and/or fan or rotor blade geometry. For example, the CIP can be fan blade leading edge stress or any other design feature (s) and/or parameter(s) (e.g., most limiting parameter to consider for impact testing). The CIP can vary based on the type of engine structure and/or sub-structure used (e.g., turbofan first stage fan blades, fan blades with part span shrouds, unshrouded wide cord fan blades, etc.), and also depends on bird velocity or bird mass (e.g., variations in bird mass affect the resulting slice mass during bird ingestion). For example, the CIP can be any of a leading-edge stress, a blade root stress (e.g., for first stage fan blades), a blade deflection producing shroud shingling (e.g., for fan blades with part span shrouds), or a blade twist in a dovetail leading to trailing blade impact (e.g., for unshrouded wide chord fan blades).

Small, medium, and/or single large bird ingestion tests can be performed to ensure engine tolerance to potential bird ingestion and compliance with regulatory guidelines. For example, bird debris impact can damage critical internal components if the engine lacks sufficient strength and/or resistance to bird ingestion events (e.g., frame struts or strut fairings housing fuel, oil, high pressure bleed air lines, etc.). As such, effects of bird strikes should be investigated to account for rotating components, compressor casing strength, potential blade failure, and/or strength of engine structure(s) and/or shaft(s). Additionally, engine response to a large bird ingestion can be evaluated to account for effects of engine unbalance loads, surge related loads, torque loads, and/or axial loads. For example, testing can focus on targeting an artificial bird for a core primary flowpath and/or over a fan face area (e.g., allowing for an even distribution of bird targets over an engine's front face), determining whether a particular bird size passes through the engine inlet into the rotor blades, and/or identifying whether the engine can maintain a specific take-off power or thrust level after a bird ingestion event.

Current methods to determine engine response to an ingestion event can include use of real bird bodies during aircraft component testing. Artificial birds provide an alternative to the use of bird carcasses, reducing the need to euthanize birds for testing purposes as well as reducing overall costs and achieving reproducible testing results. While used for pre-certification testing to prove bird-strike resistance of aircraft components, artificial birds may not be designed based on the physical properties of real birds, but instead represent artificial projectiles that are fired at an aircraft component at an operational velocity that would be representative of a potential bird strike. In some examples, a number of different shapes can be used to create a mass, density, diameter, and/or length of the artificial projectile for use during targeted bird strike testing. Additionally, internal densities of the artificial projectiles vary and may not accurately mimic the density of a real bird for a range of bird species.

Methods and apparatus disclosed herein for artificial bird manufacturing allow for consistent and reproducible formation of structures that have bird-like features that reflect the amount of energy that can be released during bird ingestion by a turbine engine. Additionally, methods and apparatus disclosed herein allow for a systematic method for processing and handling an artificial bird for purposes of impact testing of an aircraft engine, including stationary and/or rotating engine components. Examples disclosed herein describe the use of a mold to form an artificial bird based on crushed ice processing (e.g., layering, compression, etc.). As such, an artificial bird can be manufactured that represents the type of impact that a real bird can cause during a bird ingestion event (e.g., kinetic energy release), while permitting the formation of a structure that is uniform in shape and density, thereby allowing for consistent testing and analysis correlation. Furthermore, methods and apparatus disclosed herein permit the artificial bird to remain intact (e.g., not break up) when it is mounted and released during testing. While methods and apparatus disclosed herein focus on artificial bird manufacturing for purposes of turbine engine testing, the methods and apparatus disclosed herein can be used for testing of any applicable blade-based equipment (e.g., wind turbines, etc.) and/or any structural testing for potential aviation-related bird-based collisions.

In the following detailed description, reference is made to the accompanying drawings that form a part hereof, and in which is shown by way of illustration specific examples that may be practiced. These examples are described in sufficient detail to enable one skilled in the art to practice the subject matter, and it is to be understood that other examples may be utilized. The following detailed description is therefore, provided to describe an exemplary implementation and not to be taken limiting on the scope of the subject matter described in this disclosure. Certain features from different aspects of the following description may be combined to form yet new aspects of the subject matter discussed below.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B is intended to refer to implementations including any of (1) at least one A, (2) at least one B, and (3) at least one A and at least one B. Similarly, as used herein in the context of describing the performance or execution of processes, instructions, actions, activities and/or steps, the phrase "at least one of A or B is intended to refer to implementations including any of (1) at least one A, (2) at least one B, and (3) at least one A and at least one B.

As used herein, singular references (e.g., "a", "an", "first", "second", etc.) do not exclude a plurality. The term "a" or "an" entity, as used herein, refers to one or more of that entity. The terms "a" (or "an"), "one or more", and "at least one" can be used interchangeably herein. Furthermore, although individually listed, a plurality of means, elements or method actions may be implemented by, e.g., a single unit or processor. Additionally, although individual features may be included in different examples or claims, these may possibly be combined, and the inclusion in different examples or claims does not imply that a combination of features is not feasible and/or advantageous.

As used herein, the terms "system," "unit," "module,", "engine,", "component," etc., may include a hardware and/or software system that operates to perform one or more functions. For example, a module, unit, or system may include a computer processor, controller, and/or other logic-based device that performs operations based on instructions stored on a tangible and non-transitory computer readable storage medium, such as a computer memory. Alternatively, a module, unit, or system may include a hard-wires device that performs operations based on hard-wired logic of the device. Various modules, units, engines, and/or systems shown in the attached figures may represent the hardware that operates based on software or hardwired instructions, the software that directs hardware to perform the operations, or a combination thereof.

FIG. 1A illustrates an example artificial bird assembly 100 formed with layered ice using an example mold 115, based on methods and apparatus disclosed herein. In the example of FIG. 1A, an artificial bird 105 is formed by creating ice layer(s) 110*a*, 110*b* inside the mold 115. In some examples, the ice layer(s) 110*a*, 110*b* can include crushed ice. As described in connection with FIGS. 3-4, the layered ice structure can be used to create an artificial bird (e.g., an ice bird) with uniform density and/or a uniform shape. In the example of FIG. 1A, the mold 115 can be made of any material suitable for ice containment (e.g., plastic, metal, etc.). In some examples, the mold 115 can take any shape that can be used as a projectile representing a bird striking a region of an aircraft. While in the example of FIG. 1A the mold 115 is a straight-ended cylinder, the mold 115 can take any other shape (e.g., hemispherical ended cylinder, ellipsoid, etc.) and/or diameter. In some examples, the diameter can be a more critical parameter than the mold length and/or shape (e.g., slicing of an object by rotating airfoils can be more dependent on the diameter of the object than its length). In some examples, the mold 115 height can range from 10-20 inches. In some examples, the height and/or diameter of the mold 115 can depend on a desired bird class to be tested (e.g., total weight of the artificial bird, ranging from 1-5 kilograms). In some examples, the diameter of the mold 115 can vary based on the desired bird class (e.g., from 0.07-0.2 meters). In some examples, any number of crushed ice layer(s) 110*a*, 110*b* (e.g., as shown using an example enlarged view 108 of the artificial bird 105) can be used to fill the example mold 115. Once the mold 115 has been filled with the crushed ice layer(s) 110*a*, 110*b*, as described in connection with FIGS. 3-4, the artificial bird 105 can be removed from the mold 115, yielding a free-standing structure (e.g., shown positioned on an example base 112). In some examples, the height of the resulting artificial bird 105 is the same height as the mold 115, whereas in other examples the height of the artificial bird is less than the total height of the mold 115.

Figure 1B:
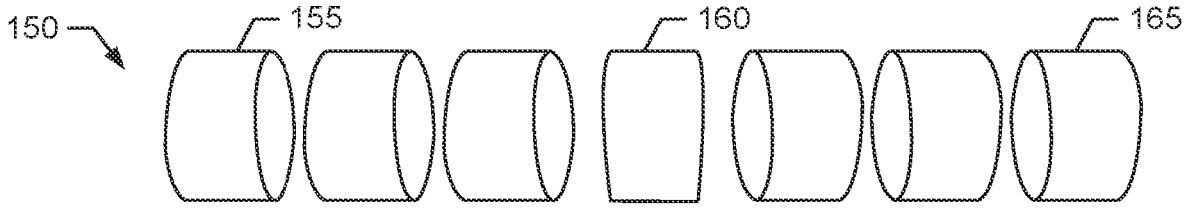
FIG. 1B illustrates example sectioning of the artificial bird of FIG. 1A to determine density of the formed sections, based on example methods disclosed herein.

FIG. 1B illustrates an example sectioning 150 of the artificial bird 105 of FIG. 1A to determine density of the formed sections, based on example methods disclosed herein. For example, once the artificial bird 105 has been formed using multiple layers of crushed ice (e.g., layers 110*a*, 110*b*), the uniformity of the density of the artificial bird 105 can be verified by determining the density of one or more of the equally-sized sections. In some examples, the resulting artificial bird 105 can be trimmed to a desired height by removing sections of the ice from the top and/or bottom of the artificial bird 105 (e.g., sections 155, 165). In some examples, each of the sections of the artificial bird 105 shown in FIG. 1B can have the section density measured and/or recorded (e.g., including sections 155, 160, and/or 165) to identify whether the resulting densities are consistent throughout the artificial bird 105 and/or whether the density matches the desired density for an artificial bird. In some examples, the desired bird density can be determined based on existing measurements of avian body densities (e.g., based on species, age, length, diameter, wingspan, etc.). For example, the body density measurements can be based on water displacement. In some examples, the mean dry densities for avian species can range from 0.60-1.0 grams per centimeter cubed (g/cm$^3$). As such, artificial birds can be formed based on a variety of anticipated bird densities that can be encountered during flight (e.g., including birds with low densities that can be present in flocks, as opposed to a single bird with a high density). Confirming the density of the ice sections (e.g., sections 155, 160, and/or 165) allows for verification of the overall artificial bird 105 density, with the ice-layering process of FIG. 1A repeated and/or modified to ensure that a uniform density throughout the entire ice structure is achieved while matching the desired bird class density intended for aircraft component testing during a simulated bird ingestion event.

Figure 1C:
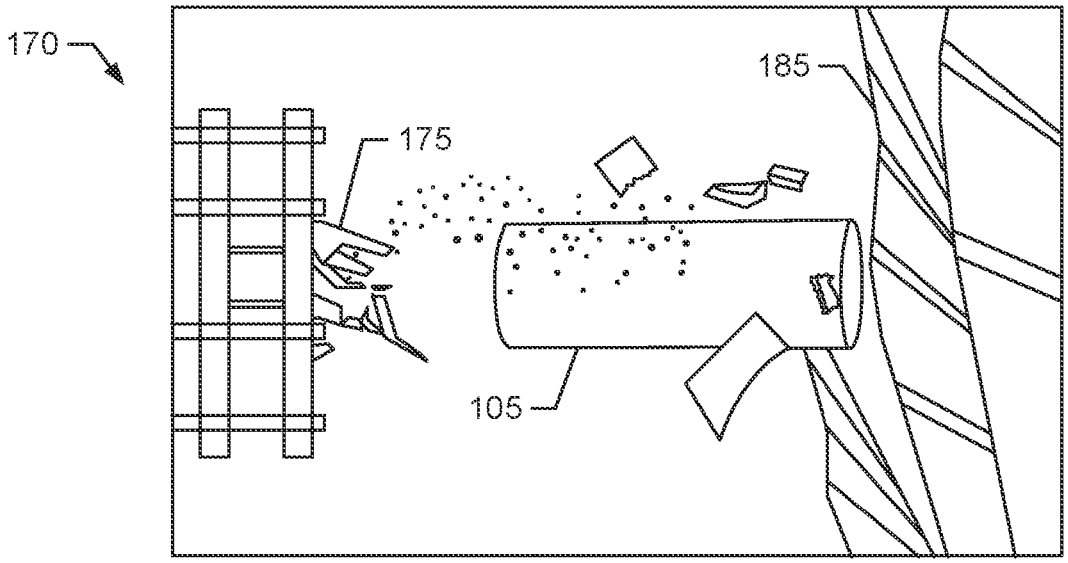
FIG. 1C illustrates example impact testing using the artificial bird of FIG. 1A to determine engine component resistance to bird ingestion effects.

FIG. 1C illustrates an example impact testing 170 using the artificial bird 105 of FIG. 1A to determine engine component resistance to bird ingestion effects. Impact testing can be performed to allow for the artificial bird 105 to impact any area of an engine, including example engine fan blades 185. In the example of FIG. 1C, the artificial bird 105 is mounted on an example sabot 175 prior to being released into the testing area of the engine (e.g., towards engine fan blades 185). In some examples, a velocity of the artificial bird 105 can be tracked during testing (e.g., using paper velocity targets inserted into the crushed ice). In some examples, multiple areas can be analyzed to determined how a bird ingestion event affects engine performance, including testing with multiple artificial bird(s) 105 simultaneously. In some examples, generated energy input resulting from an artificial bird strike can be compared to generated energy input levels measured when real birds are used for impact testing. As such, additional adjustments of artificial bird parameters (e.g., density, length, width, etc.) can be made to create an artificial bird that closely replicates impact conditions experienced when using real birds. For example, the shape and/or size of the mold 115 can be varied, while the total number of ice layers (e.g., ice layers 110*a*, 110*b*) can be adjusted and/or the granularity of crushed ice can be modified. In some examples, the example impact testing 170 of FIG. 1C can include a tank for holding pressurized air, a pressure release valve, a chamber of holding a sabot (e.g., to secure the artificial bird), a tube for directing the bird as it is accelerated by pressurized air, and/or instrumentation for artificial bird velocity and/or orientation measurement(s). In some examples, high speed photography can be used to capture the results of the impact testing using the artificial bird as a projectile. Additionally, multiple launches of the artificial bird 105 can be performed for certain rotating target tests to account for various strike positions (e.g., between two blades, a back of the blade, etc.).

Figure 2:
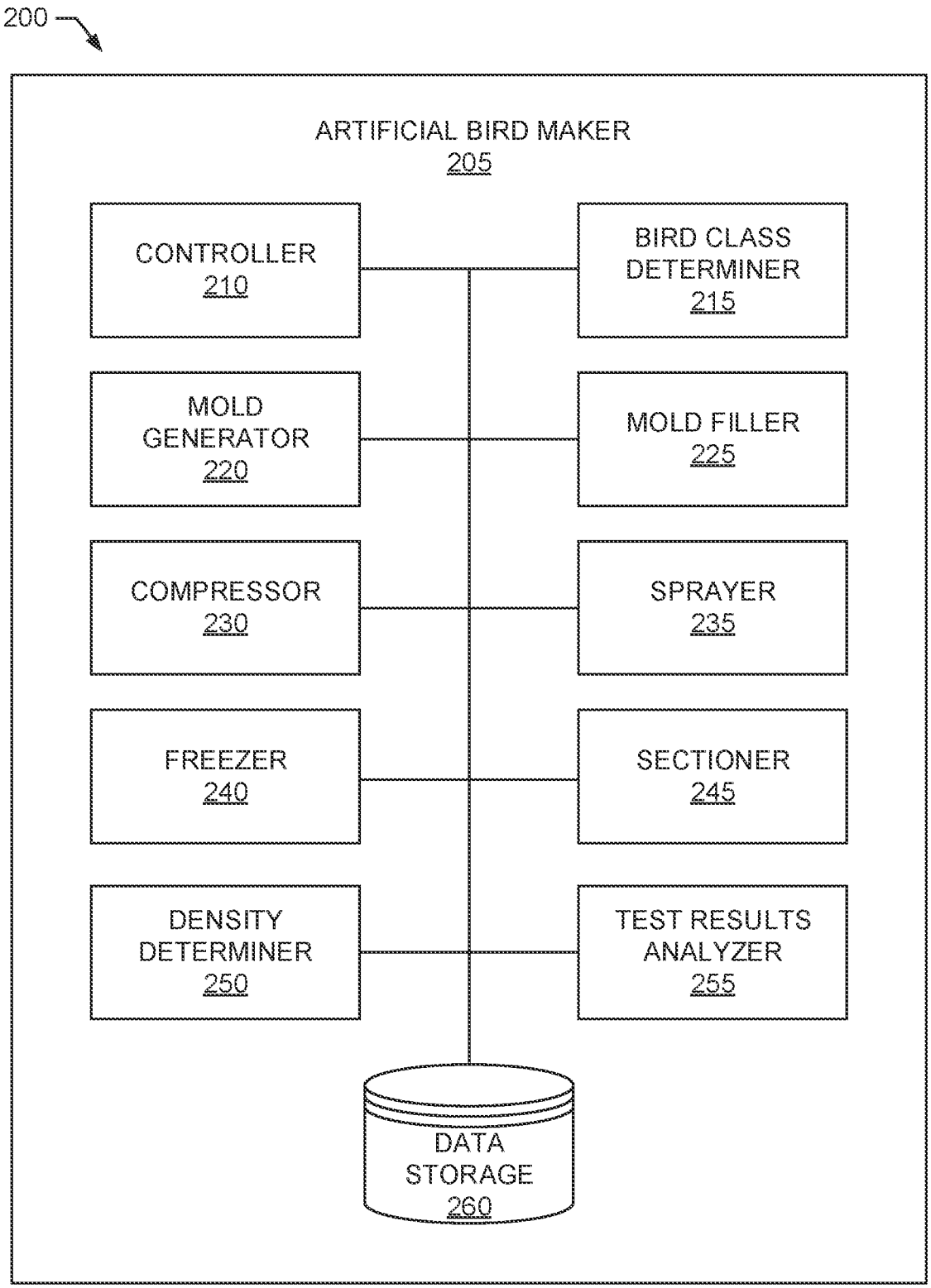
FIG. 2 is a block diagram of an example implementation of an artificial bird maker by which the examples disclosed herein can be implemented.

FIG. 2 is a block diagram 200 of an example implementation of an artificial bird maker 205 by which the examples disclosed herein can be implemented. The artificial bird maker 205 includes an example controller 210, an example bird class determiner 215, an example mold generator 220, an example mold filler 225, an example compressor 230, an example sprayer 235, an example freezer 240, an example sectioner 245, an example density determiner 250, an example test results analyzer 255, and/or an example data storage 260.

The controller 210 controls the artificial bird making process, including determining the desired bird class using the bird class determiner 215, generating a mold (e.g., based on the desired bird class) using the mold generator 220, filling the mold (e.g., with crushed ice) using the mold filler 225, compressing the crushed ice using the compressor 230, spraying one or more layers of the ice (e.g., to mist the ice surface with water) using the sprayer 235, freezing and/or refreezing the crushed ice layers using the freezer 240, sectioning the formed ice structure using the sectioner 245, determining the density of the ice structure using the density determiner 250, assessing test results (e.g., from density measurements, etc.) using the test results analyzer 255, and/or storing parameters (e.g., input by a user and/or determined by the artificial bird maker 205) in the data storage 260. In some examples, the controller 210 modifies settings (e.g., temperature, ice granularity, freezing time, number of ice layers, etc.) based on inputs provided by a user and/or determined during testing and assessment of a given formed artificial bird (e.g., based on desired criteria of the finalized artificial bird structure). For example, the controller 210 can modify a mold shape (e.g., length, diameter, etc.) based on a desired bird class (e.g., bird size, weight, etc.). In some examples, the controller 210 fills a mold with a given number of ice layers based on the mold parameters and/or the desired artificial bird density.

The bird class determiner 215 determines a bird class identification for an artificial bird. For example, the bird class can be based on an intended final artificial bird size (e.g., small, medium, large) and/or the intended artificial bird parameters (e.g., length, width, weight, etc.). In some examples, the bird class determiner 215 can receive input from a user that specifies the type and/or number of artificial birds that need to be manufactured. In some examples, the bird class determiner 215 determines the bird density that corresponds to a given bird class (e.g., 0.60-1.0 g/cm$^3$). In some examples, the bird class determiner 215 identifies the type of artificial bird to manufacture based on desired avian body characteristics (e.g., species, age, diameter, wingspan, etc.).

The mold generator 220 generates a mold (e.g., mold 115 of FIG. 1) used to form an artificial bird (e.g., artificial bird 105 of FIG. 1A). For example, the mold generator 220 can generate the mold 115 based on a desired bird class (e.g., as determined using the bird class determiner 215). The generated mold can be any shape, size, and/or material (e.g., metal, polymer, etc.). In some examples, the mold generator 220 selects a mold material (e.g., type of metal, polymer, etc.) based on the type of material that is suitable for the formation of an ice-based artificial bird, as described in more detail in connection with FIGS. 3-4. In some examples, the mold generator 220 can generate multiple molds, depending on the type of bird class and/or total number of artificial birds required for bird ingestion testing, as described in connection with FIG. 1C. In some examples, the molds can be pre-made based on user preferences for the artificial bird dimensions.

The mold filler 225 fills the mold (e.g., generated using the mold generator 220) with layers of ice (e.g., crushed ice). In some examples, the mold filler 225 determines the amount of ice needed (e.g., total weight of ice that requires crushing prior to filling the mold). In some examples, the mold filler 225 determines a ratio of water to ice that the mold 115 is filled with for a certain bird class. In some examples, the mold filler 225 weighs the crushed ice in real-time to determine the amount of ice crushed (e.g., amount of ice to add and/or subtract from the mold). In some examples, the mold filler 225 includes a colored dye (e.g., mixed with the ice) to allow the artificial bird to have a designated color (e.g., for identification purposes, etc.). Prior to filling of the mold 115, the mold filler 225 can prepare the ice formulation using a mixer until a desired consistency of the ice is reached. Once the ice formulation is prepared, the mold filler 225 can pour the crushed ice into the mold 115 (e.g., layer-by-layer). For example, the mold filler 225 can fill the mold with a first layer of crushed ice followed by a second layer of crushed ice. In some examples, the first layer and/or the second layer of the crushed ice (e.g., layers 110*a*, 110*b* of FIG. 1A) is compressed using the compressor 230 and/or sprayed with water using the sprayer 235 (e.g., to moisten the ice layer surface) prior to layering of a subsequent ice layer by the mold filler 225.

The compressor 230 compresses the crushed ice inside the mold 115. In some examples, the compressor can use a tamper (e.g., flat tamper, cleated tamper, etc.) to apply compression strokes to the ice layer surface (e.g., the surface of layers 110*a*, 110*b*). For example, the application of multiple compression strokes (e.g., 3-10 strokes) to the ice surface layer(s) can create indentation on the surface of the ice. In some examples, any other type of compressive force application can be used to compress the ice layer(s) during layers of the crushed ice by the mold filler 225. In some examples, all ice layers within the mold can be compressed prior to the application of each subsequent ice layer. In some examples, designated ice layer(s) can be compressed depending on the desired consistency and/or final density of the artificial bird 105.

The sprayer 235 sprays and/or mists the surface of the ice layers (e.g., layers 110*a*, 110*b*). For example, the sprayer 235 can evenly mist the ice layer surface(s) with water prior to the addition of a subsequent crushed ice layer (e.g., using the mold filler 225). For example, misting the ice layer surface(s) can improve the bond between the crushed ice layer(s) 110*a*, 110*b*. In some examples, the sprayer 235 mists each surface of the ice layer(s) within the mold 115. In some examples, the sprayer 235 mists the surface(s) of the ice layer(s) within the mold selectively (e.g., based on the bonding strength between the ice layer(s)).

The freezer 240 freezes the crushed ice layer(s) inside the mold 115. For example, once the mold filler 225 has filled the mold 115 with the ice layer(s), the freezer 240 re-freezes the crushed ice inside the mold (e.g., 10-20 hours). In some examples, the freezer 240 regulates the ambient temperature (e.g., between −25 degrees Celsius to −10 degrees Celsius). In some examples, the freezer 240 can be used to refreeze the crushed ice within the mold 115 before the entire mold has been filled with the one or more crushed ice layer(s).

The sectioner 245 cuts the artificial bird 105 into sections to adjust the artificial bird 105 length and/or determine the ice density of the formed ice structure representing the artificial bird 105. In some examples, the sectioner 245 sections the re-frozen crushed ice into sections of equivalent size (e.g., sections 155, 160, 165 of FIG. 1B). In some examples, the sectioner 245 cuts the artificial bird 105 using a saw and/or any other sectioning technique that permits sectioning of ice. In some examples, the sectioner 245 prevents the artificial bird 105 from melting during the sectioning process (e.g., using wooden V blocks, etc.). In some examples, the sectioner 245 sections a top and/or a bottom of the artificial bird 105 to cut the bird down to a desired size (e.g., lengthwise).

The density determiner 250 determines the density of the artificial bird 105. For example, the density determiner 250 can determine the ice density of one or more of the sections obtained using the sectioner 245. In some examples, the density determiner 250 determines whether the density of the artificial bird 105 is uniform and/or corresponds to the desired density of the selected bird class (e.g., based on the bird class determiner 215). In some examples, the artificial bird 105 sectioned using the sectioner 245 to determine whether the ice density of the artificial bird 105 is uniform is not further used for bird ingestion testing. For example, once the artificial bird 105 density has been confirmed to be consistent throughout the entire ice structure, the artificial bird maker 205 can be used to form one or more artificial bird(s) 105 based on the methodology (e.g., temperature setting, number of compression strikes, etc.) that yielded the desired bird size and/or density.

The test results analyzer 255 analyzes the determined ice densities obtained during testing and/or development of the artificial bird(s) 105 to compare the ice densities to known and/or desired ice densities for a given bird class. In some examples, the test results analyzer 255 determines whether the developed artificial bird(s) 105 yields the level of kinetic energy during impact testing (e.g., on a turbofan structure) that would be expected when using real birds. For example, the test results analyzer 255 can be used to determine kinetic energy release over time during impact testing and/or assess the impact effect on a given structure of the engine. In some examples, the test results analyzer 255 can determine whether the energy input of the artificial bird 105 corresponds to the energy input of a real bird at various impact points along a given aircraft structure (e.g., strain comparison). In some examples, the test results analyzer 255 determines the target density of the artificial bird and identifies the range of densities that fall within the target density range without significant variation from the target density (e.g., an upper limit and/or a lower limit acceptable for the final artificial bird 105 density).

The data storage 260 stores any information associated with the artificial bird maker 205. For example, the data storage 260 can store bird class determinations made by the bird class determiner 215, mold parameters determined using the mold generator 220, a number of ice layers used to fill the mold 115 using the mold filler 225, the number of compression stokes performed using the compressor 230, the amount and/or duration of misting performed by the sprayer 235, the temperature(s) used for re-freezing by the freezer 240, the density values determined during ice density evaluation using the density determiner 250, and/or the artificial bird testing results obtained using the test results analyzer 255 (e.g., impact testing results, energy expenditures, etc.). The example data storage 260 of the illustrated example of FIG. 2 is implemented by any memory, storage device and/or storage disc for storing data such as flash memory, magnetic media, optical media, etc. Furthermore, the data stored in the example data storage 260 can be in any data format such as binary data, comma delimited data, tab delimited data, structured query language (SQL) structures, image data, etc.

While an example implementation of the artificial bird maker 205 is illustrated in FIG. 2, one or more of the elements, processes and/or devices illustrated in FIG. 2 may be combined, divided, re-arranged, omitted, eliminated and/or implemented in any other way. Further, the example controller 210, the example bird class determiner 215, the example mold generator 220, the example mold filler 225, the example compressor 230, the example sprayer 235, the example freezer 240, the example sectioner 245, the example density determiner 250, the example test results analyzer 255, and/or, more generally, the example artificial bird maker 205 of FIG. 2 may be implemented by hardware, software, firmware and/or any combination of hardware, software and/or firmware. Thus, any of the example controller 210, the example bird class determiner 215, the example mold generator 220, the example mold filler 225, the example compressor 230, the example sprayer 235, the example freezer 240, the example sectioner 245, the example density determiner 250, the example test results analyzer 255, and/or, more generally, the example artificial bird maker 205 of FIG. 2 can be implemented by one or more analog or digital circuit(s), logic circuits, programmable processor(s), programmable controller(s), graphics processing unit(s) (GPU(s)), digital signal processor(s) (DSP(s)), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example controller 210, the example bird class determiner 215, the example mold generator 220, the example mold filler 225, the example compressor 230, the example sprayer 235, the example freezer 240, the example sectioner 245, the example density determiner 250, the example test results analyzer 255, and/or, more generally, the example artificial bird maker 205 of FIG. 2 is/are hereby expressly defined to include a non-transitory computer readable storage device or storage disk such as a memory, a digital versatile disk (DVD), a compact disk (CD), a Blu-ray disk, etc. including the software and/or firmware. Further still, the example artificial bird maker 205 of FIG. 2 may include one or more elements, processes and/or devices in addition to, or instead of, those illustrated in FIG. 2, and/or may include more than one of any or all of the illustrated elements, processes and devices. As used herein, the phrase "in communication," including variations thereof, encompasses direct communication and/or indirect communication through one or more intermediary components, and does not require direct physical (e.g., wired) communication and/or constant communication, but rather additionally includes selective communication at periodic intervals, scheduled intervals, aperiodic intervals, and/or one-time events.

Figure 3:
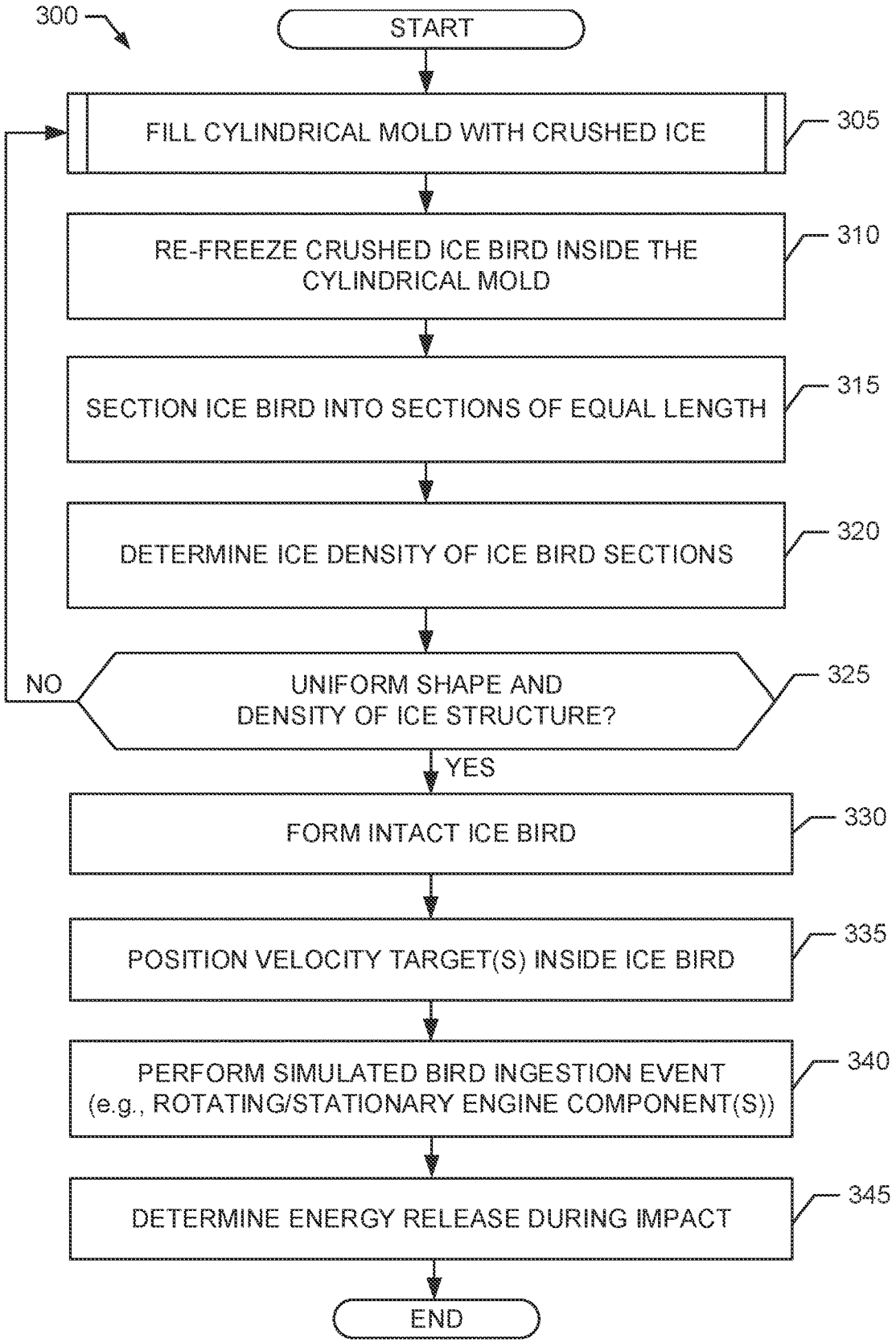
FIG. 3 illustrates a flowchart representative of example machine readable instructions which may be executed to implement the example artificial bird maker of FIG. 2.
Figure 4:
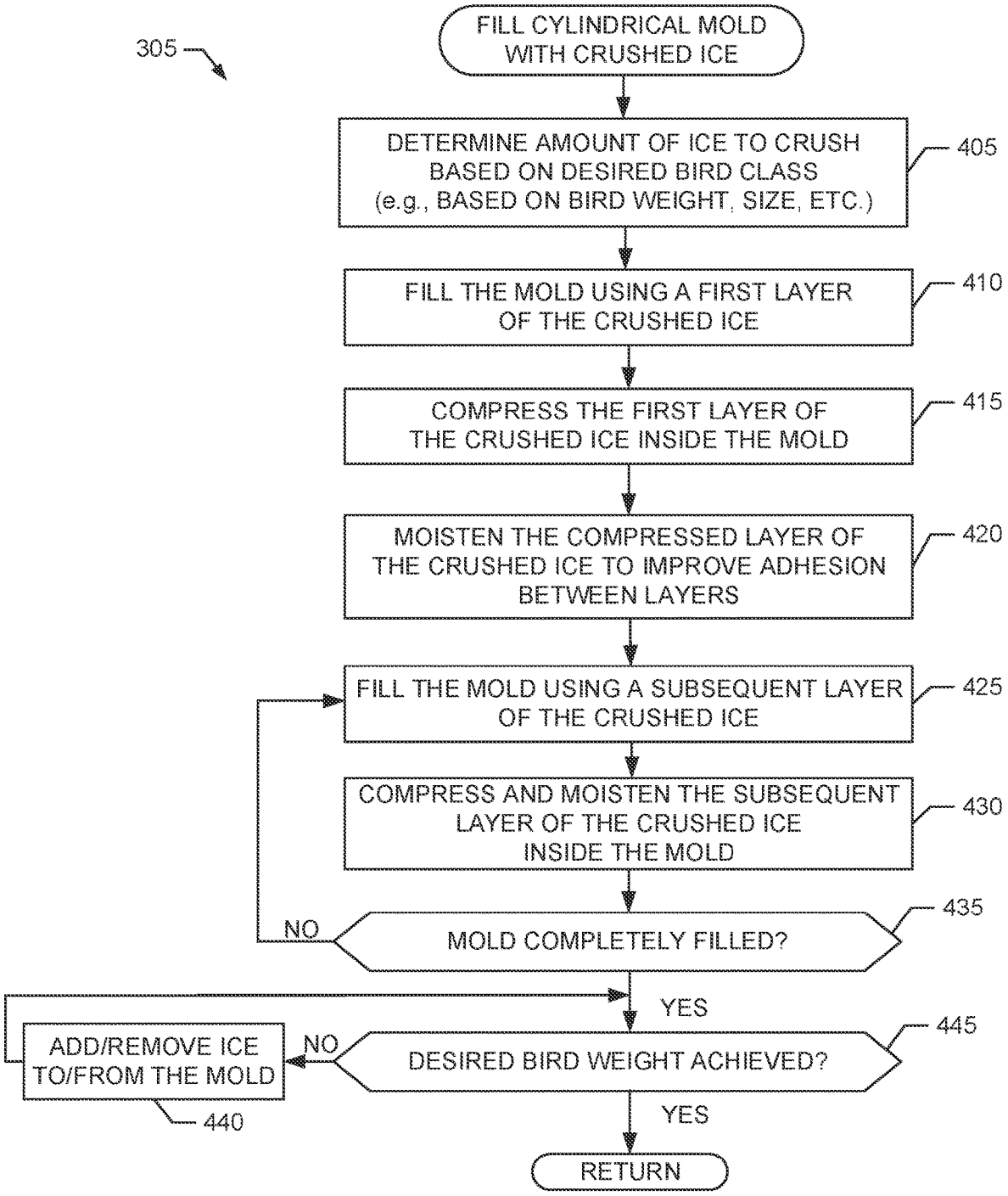
FIG. 4 illustrates a flowchart representative of example machine readable instructions which may be executed to fill a cylindrical mold with crushed ice during artificial bird manufacturing using the example artificial bird maker of FIG. 2.

Flowcharts representative of example hardware logic, machine readable instructions, hardware implemented state machines, and/or any combination thereof for implementing the example artificial bird maker 205 are shown in FIGS. 3-4. The machine readable instructions may be one or more executable programs or portion(s) of an executable program for execution by a computer processor such as the processor 512 shown in the example processor platform 500 discussed below in connection with FIG. 5. The program may be embodied in software stored on a non-transitory computer readable storage medium such as a CD-ROM, a floppy disk, a hard drive, a DVD, a Blu-ray disk, or a memory associated with the processor 512, but the entire program and/or parts thereof could alternatively be executed by a device other than the processor 512 and/or embodied in firmware or dedicated hardware. Further, although the example program is described with reference to the flowchart illustrated in FIGS. 3-4, many other methods of implementing the example artificial bird maker 205 may alternatively be used. For example, the order of execution of the blocks may be changed, and/or some of the blocks described may be changed, eliminated, or combined. Additionally or alternatively, any or all of the blocks may be implemented by one or more hardware circuits (e.g., discrete and/or integrated analog and/or digital circuitry, an FPGA, an ASIC, a comparator, an operational-amplifier (op-amp), a logic circuit, etc.) structured to perform the corresponding operation without executing software or firmware.

The machine readable instructions described herein may be stored in one or more of a compressed format, an encrypted format, a fragmented format, a compiled format, an executable format, a packaged format, etc. Machine readable instructions as described herein may be stored as data (e.g., portions of instructions, code, representations of code, etc.) that may be utilized to create, manufacture, and/or produce machine executable instructions. For example, the machine readable instructions may be fragmented and stored on one or more storage devices and/or computing devices (e.g., servers). The machine readable instructions may require one or more of installation, modification, adaptation, updating, combining, supplementing, configuring, decryption, decompression, unpacking, distribution, reassignment, compilation, etc. in order to make them directly readable, interpretable, and/or executable by a computing device and/or other machine. For example, the machine readable instructions may be stored in multiple parts, which are individually compressed, encrypted, and stored on separate computing devices, wherein the parts when decrypted, decompressed, and combined form a set of executable instructions that implement a program such as that described herein.

In another example, the machine readable instructions may be stored in a state in which they may be read by a computer, but require addition of a library (e.g., a dynamic link library (DLL)), a software development kit (SDK), an application programming interface (API), etc. in order to execute the instructions on a particular computing device or other device. In another example, the machine readable instructions may need to be configured (e.g., settings stored, data input, network addresses recorded, etc.) before the machine readable instructions and/or the corresponding program(s) can be executed in whole or in part. Thus, the disclosed machine readable instructions and/or corresponding program(s) are intended to encompass such machine readable instructions and/or program(s) regardless of the particular format or state of the machine readable instructions and/or program(s) when stored or otherwise at rest or in transit.

The machine readable instructions described herein can be represented by any past, present, or future instruction language, scripting language, programming language, etc. For example, the machine readable instructions may be represented using any of the following languages: C, C++, Java, C#, Perl, Python, JavaScript, HyperText Markup Language (HTML), Structured Query Language (SQL), Swift, etc.

As mentioned above, the example processes of FIGS. 3-4 can be implemented using executable instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media.

FIG. 3 illustrates a flowchart representative of example machine readable instructions 300 which may be executed to implement the example artificial bird maker 205 of FIG. 2. In some examples, the artificial bird maker 205 determines the type of bird class to which the artificial bird (e.g., artificial bird 105 of FIG. 1A) will correspond. For example, the artificial bird maker 205 uses the bird class determiner 215 to receive user input on the type of bird (e.g., small, medium, large) and/or the bird characteristics (e.g., weight, species, age, etc.) that the manufactured artificial bird 105 should represent (e.g., based on final density measurements). Once the bird class has been selected, the mold generator 220 generates a mold that is representative of the shape and/or size that will correspond to the desired bird class (e.g., using an additive manufacturing process according to dimensions specified in a program file, etc.). For example, the mold 115 can have a designated height and/or diameter based on the selected bird class. In the example of FIG. 1A, the mold 115 is a cylindrical mold made of aluminum. Once the mold generator 220 generates the mold 115, the mold filler 225 fills the mold 115 with crushed ice, as described in more detail in connection with FIG. 4 (block 305). For example, the mold filler 225 fills the mold 115 with crushed ice layers (e.g., layer(s) 110*a*, 110*b*), with the layers compressed and/or misted in between layering (e.g., using the compressor 230 and/or the sprayer 235). Once the mold 115 has been filled with the crushed ice, the artificial bird maker 205 uses the freezer 240 to re-freeze the crushed ice within the mold 115 (block 310). For example, the crushed ice can be re-frozen overnight and/or for a period of 10-20 hours. Once the artificial bird (e.g., ice bird) has been re-frozen, it can be removed from the mold 115 to yield the artificial bird 105 as shown in the example of FIG. 1A. In some examples, the mold 115 is maintained at room temperature until the artificial bird 105 can be removed from the mold 115. In some examples, any portion of the artificial bird 105 that comes into contact with another surface that has a higher temperature should be insulated to prevent such a region of the artificial bird 105 from thawing faster than any other bird 105 ice surface. In some examples, once the artificial bird 105 has been removed from the mold 115, the freezer 240 can be used to return the artificial bird 105 to the temperatures at which the crushed ice layers within the mold 115 were re-frozen prior to the removal of the artificial bird 105 from the mold 115 (e.g., −25 degrees Celsius to −10 degrees Celsius).

The artificial bird maker 205 can further use the sectioner 245 to section the artificial bird 105 into one or more sections that can be used for evaluating the ice density of the artificial bird 105 (block 315). For example, the sectioner 245 sections the artificial bird 105 into sections of equal length (e.g., a total of seven sections of equal length), as described in connection with FIG. 1B. For example, the sectioner 245 sections the artificial bird 105 using a saw with wooden V-shaped blocks to prevent an area of the ice being sectioned from melting. The density determiner 250 uses the sectioned artificial bird 105 of FIG. 1B to determine whether the formed artificial bird 105 has a uniform density. For example, the density determiner 250 determines the density of each of the artificial bird 105 sections (e.g., sections 155, 160, 165) (block 320). In some examples, the density of an ice section can be determined based on a measurement of the ice section mass and the ice section volume (e.g., by determining a length and/or a weight for each section). In some examples, the controller 210 can be used to modify settings of the artificial bird maker 205 to yield an artificial bird 105 with uniform density. For example, the controller 210 can adjust a mold 115 shape and/or size, the total amount of the mold 115 being filled, the total number of compression strokes, the total number of ice layers within the mold, the duration and/or extend of the ice surface layer misting, and/or the re-freezing conditions. The artificial bird maker 205 can adjust any of these variables to yield a uniform shape and/or density of the artificial bird 105 structure. For example, once an initial artificial bird 105 results in a uniform density and/or a uniform shape (block 325), the artificial bird maker 205 can proceed to form an intact artificial bird 105 that is not sectioned using the sectioner 245 (e.g., for purposes of bird ingestion testing) (block 330). If additional adjustment of the artificial bird formation actions is warranted to yield an ice bird with a uniform density and a uniform shape, control returns to the mold filler 225 (block 305). In some examples, control returns to the mold generator 220 if mold dimensions are adjusted and/or a newly formed mold 115 is needed.

Once an artificial bird 105 has been formed with uniform density and the production of artificial bird(s) 105 begins for purposes of bird ingestion testing, a portion (e.g., at least one out of 20-30, etc.) of artificial birds can be tested during production to ensure that the density of the artificial bird remains consistent. In some examples, fluctuations in the ambient conditions can require more frequent testing (e.g., sectioning of a sample bird to determine its density) during the production process. To prepare the artificial bird(s) 105 for impact testing, the artificial bird maker 205 can position velocity target(s) inside the artificial bird 105 (block 335). For example, diameter paper velocity targets can be inserted into the artificial bird 105. For example, a total of size velocity targets can be positioned inside the artificial bird 105 by melting the side of the bird near the top, middle and bottom of the artificial bird 105 (e.g., using a target insertion tool) and inserting the velocity target(s). In some examples, the velocity targets can be further positioned at 120 degrees from the first velocity target set (e.g., for a slice view camera). In some examples, the freezer 240 freezes the artificial bird 105 once the velocity targets have been inserted into the bird and a few drops of water positioned over the top of the targets (e.g., to secure the targets within the bird).

Artificial bird(s) 105 manufactured for purposes of impact testing can be used by the artificial bird maker 105 to perform simulated bird ingestion on stationary and/or rotating engine components (block 340). For example, as described in connection with FIG. 1C, the artificial bird 105 can be mounted on the sabot 175 prior to being released into the testing area of the engine (e.g., towards engine fan blades 185). In some examples, a velocity of the artificial bird 105 can be tracked during testing (e.g., using the paper velocity targets inserted into the crushed ice). In some examples, the artificial bird 105 can be wrapped in plastic cellophane and/or other material to prevent adhesion of the bird to any part of the sabot 175. In some examples, the cellophane can be secured to the artificial bird 105 using carton tape. In some examples, the artificial bird(s) 105 are maintained by the freezer 240 until the bird(s) are ready for impact testing. The impact testing allows the test results analyzer 255 to determine the amount of energy released during impact (block 345). This allows for assessment of engine component resistance to a bird strike, as well as testing of multiple bird densities and/or bird shapes to determine the effects of various bird characteristics (e.g., species, age, size, etc.) on a given engine structure at various operating conditions.

FIG. 4 illustrates a flowchart representative of example machine readable instructions 305 which may be executed to fill a cylindrical mold 115 with crushed ice during artificial bird 105 manufacturing using the example artificial bird maker 205 of FIG. 2. In the example of FIG. 4, the mold filler 225 determines the amount of ice to crush based on the desired bird class determined using the bird class determiner 215 (block 405). For example, the mold filler 225 can crush the weight of ice required for a certain bird class type (e.g., based on bird size, weight, etc.). Once the mold filler 225 weighs the crushed ice to confirm the correct amount of crushed ice is available, the mold filler 225 can use an ice mixer to mix the ice until a desired consistency is reached. The mold filler 225 proceeds to fill the mold 115 with a first layer of the crushed ice (e.g., filling 1-3 inches of the mold) (block 410). In some examples, the compressor 230 applies compression strokes to the surface of the first layer of the crushed ice inside the mold (block 415). For example, a flat tamper in combination with a hammer (e.g., 1-2 kilogram hammer) can be used to apply compression stroke(s) to the ice (e.g., a total of 10-30 strokes). In some examples, the flat tamper and/or a smooth tamper can be a steel tamper machined to fit into the diameter of the mold 115. In some examples, the center of the tamper can include a threaded rod for use as a handle during the compression strokes. In some examples, the compressor 230 applies additional compression strokes using a cleated tamper to create indentations in the surface of the ice. For example, the additional compression strokes using the cleated tamper can be fewer in number than the compression strokes performed using the flat tamper. In some examples, the cleated tamper can be a steel tamper machined to fit into the opening of the mold 115. In some examples, the cleated tamper includes equally sized holes that are drilled, tapped, and/or equally spaced around the perimeter of the tamper (e.g., 5-10 holes with openings of 0.5-2 centimeters, etc.). In some examples, bolts that fit into the openings of the holes drilled into the tamper are inserted to allow the end of the bolt to protrude the bottom of the tamper surface (e.g., by 0.5-2 centimeters, etc.). As such, when the ice layer(s) are compressed using the cleated tamper, the cleated tamper leaves indentations on the ice surface.

Once the compressor 230 has compressed the ice surface of the first ice layer using the flat tamper and/or the cleated tamper, the sprayer 235 can be used to moisten the compressed layer of the crushed ice with water (e.g., to improve adhesion between the ice layers) (block 420). For example, the sprayer 235 can mist the surface of the ice with water prior to the positioning of a subsequent ice layer on top of the first ice layer. The mold filler 225 fills the mold with a subsequent layer of the crushed ice (e.g., a second crushed ice layer) (block 425). In some examples, the surface of the second layer of the crushed ice can also be compressed (e.g., using the compressor 230) and/or moistened (e.g., using the sprayer 235), as described in connection with the first ice surface layer (block 430). Once the mold filler 225 has filled the mold 115 with the ice layers (block 435), the controller 210 can determine whether the desired bird weight has been achieved (block 445). If the controller 210 determines that the mold 115 is not yet filled, control returns to the mold filler 225 to proceed with filling the mold with the crushed ice layer(s) (block 425). Once the controller 210 determines that the desired bird weight has been achieved (block 445) (e.g., based on the selected bird class), the crushed ice layers within the mold 115 are re-frozen, as described in connection with FIG. 3. If the controller 210 determines that the desired bird weight has not been achieved, the mold filler 225 adds and/or removes the crushed ice from the mold 115 until the desired bird weight is achieved (block 445).

Figure 5:
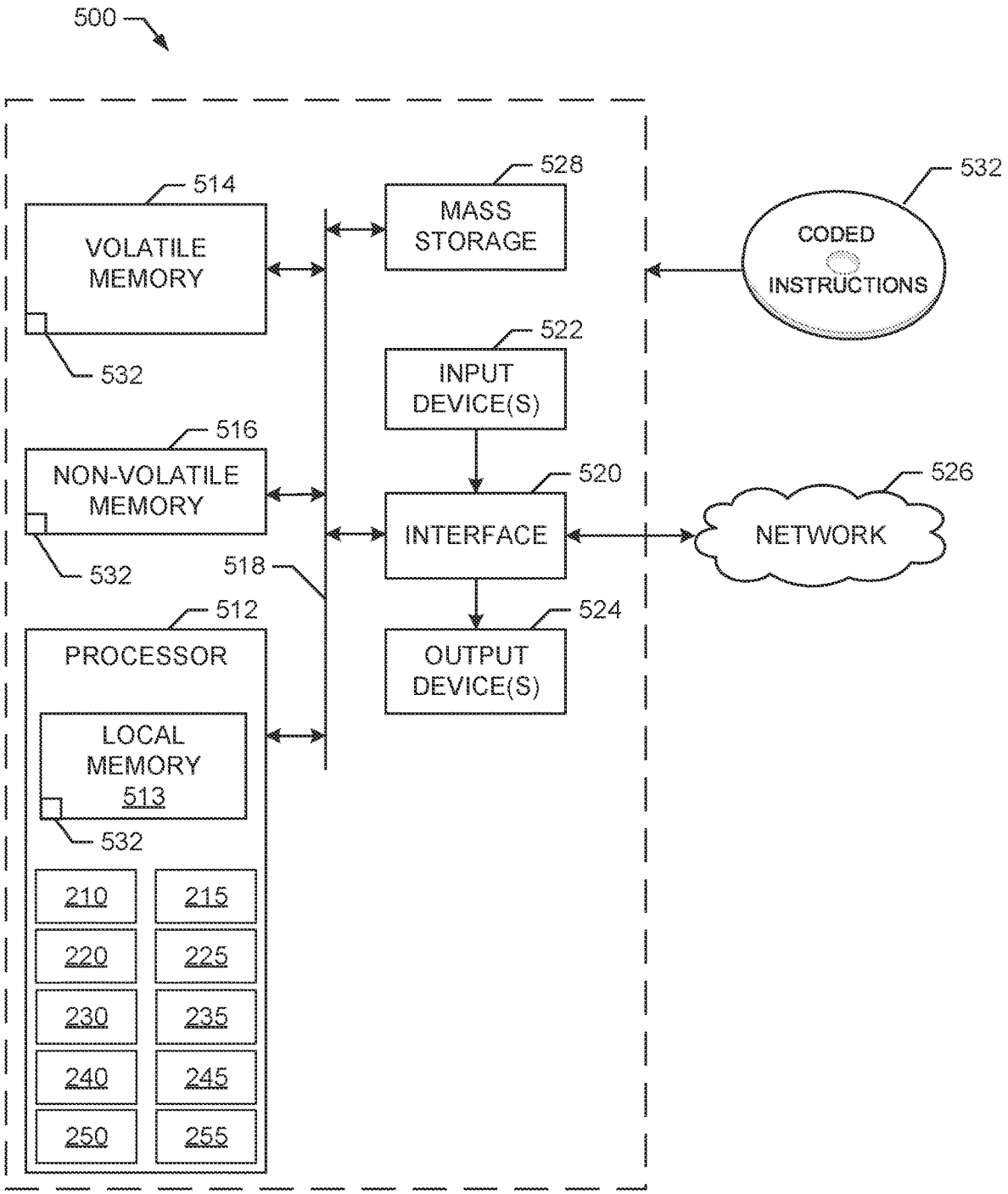
FIG. 5 is a block diagram of an example processing platform structured to execute the instructions of FIG. 3 and/or FIG. 4 to implement the example artificial bird maker of FIG. 2.

FIG. 5 is a block diagram of an example processor platform 500 structured to execute the instructions of FIG. 3 and/or FIG. 4 to implement the example artificial bird maker of FIG. 2. The processor platform 500 can be a server, a personal computer, a workstation, a self-learning machine (e.g., a neural network), or any other type of computing device.

The processor platform 500 of the illustrated example includes a processor 512. The processor 512 of the illustrated example is hardware. For example, the processor 512 can be implemented by one or more integrated circuits, logic circuits, microprocessors, GPUs, DSPs, or controllers from any desired family or manufacturer. The hardware processor may be a semiconductor based (e.g., silicon based) device. In this example, the processor 512 implements the example controller 210, the example bird class determiner 215, the example mold generator 220, the example mold filler 225, the example compressor 230, the example sprayer 235, the example freezer 240, the example sectioner 245, the example density determiner 250, and/or the example test results analyzer 255.

The processor 512 of the illustrated example includes a local memory 513 (e.g., a cache). The processor 512 of the illustrated example is in communication with a main memory including a volatile memory 514 and a non-volatile memory 516 via a bus 518. The volatile memory 514 may be implemented by Synchronous Dynamic Random Access Memory (SDRAM), Dynamic Random Access Memory (DRAM), RAMBUS® Dynamic Random Access Memory (RDRAM®) and/or any other type of random access memory device. The non-volatile memory 516 may be implemented by flash memory and/or any other desired type of memory device. Access to the volatile memory 514 and the non-volatile memory 516 is controlled by a memory controller.

The processor platform 500 of the illustrated example also includes an interface circuit 520. The interface circuit 520 may be implemented by any type of interface standard, such as an Ethernet interface, a universal serial bus (USB), a Bluetooth® interface, a near field communication (NFC) interface, and/or a PCI express interface.

In the illustrated example, one or more input devices 522 are connected to the interface circuit 520. The input device(s) 522 permit(s) a user to enter data and/or commands into the processor 512. The input device(s) 522 can be implemented by, for example, an audio sensor, a microphone, a camera (still or video), a keyboard, a button, a mouse, a touchscreen, a track-pad, a trackball, isopoint and/or a voice recognition system.

One or more output devices 524 are also connected to the interface circuit 520 of the illustrated example. The output devices 524 can be implemented, for example, by display devices (e.g., a light emitting diode (LED), an organic light emitting diode (OLED), a liquid crystal display (LCD), a cathode ray tube display (CRT), an in-place switching (IPS) display, a touchscreen, etc.), a tactile output device, a printer and/or speaker. The interface circuit 520 of the illustrated example, thus, typically includes a graphics driver card, a graphics driver chip and/or a graphics driver processor.

The interface circuit 520 of the illustrated example also includes a communication device such as a transmitter, a receiver, a transceiver, a modem, a residential gateway, a wireless access point, and/or a network interface to facilitate exchange of data with external machines (e.g., computing devices of any kind) via a network 526. The communication can be via, for example, an Ethernet connection, a digital subscriber line (DSL) connection, a telephone line connection, a coaxial cable system, a satellite system, a line-of-site wireless system, a cellular telephone system, etc.

The processor platform 500 of the illustrated example also includes one or more mass storage devices 528 for storing software and/or data. Examples of such mass storage devices 528 include floppy disk drives, hard drive disks, compact disk drives, Blu-ray disk drives, redundant array of independent disks (RAID) systems, and digital versatile disk (DVD) drives.

The machine executable instructions 532 of FIGS. 3-4 may be stored in the mass storage device 528, in the volatile memory 514, in the non-volatile memory 516, and/or on a removable non-transitory computer readable storage medium such as a CD or DVD. One or more of the volatile memory 514, in the non-volatile memory 516, the mass storage devices 528, etc., can also be used to implement the example data storage 260 of FIG. 2, for example.

From the foregoing, it will be appreciated that the disclosed methods and apparatus permit for consistent and reproducible formation of ice structures that are representative of real bird densities encountered during engine operation. For example, artificial birds formed using the methods and apparatus described herein meet the criteria for bird ingestion testing (e.g., bird densities) as set forth by the Federal Aviation Administration (FAA). For example, artificial birds formed using the methods and apparatus described herein reflect the amount of energy that can be released during bird ingestion by a turbine engine. Additionally, methods and apparatus disclosed herein allow for a systematic method for processing and handling an artificial bird for purposes of impact testing of an aircraft engine, including stationary and/or rotating engine components. As such, an artificial bird can be manufactured that represents the type of impact that a real bird can cause during a bird ingestion event (e.g., kinetic energy release), while permitting the formation of a structure that is uniform in shape and density, thereby allowing for consistent testing and analysis correlation. While the examples disclosed herein describe artificial bird fabrication for testing in aircraft-based systems, the methods and apparatus disclosed herein can be used for testing of the structural components of any type of engine and/or vehicle that encounters strikes with objects that are within the range of the aforementioned bird densities.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

The following claims are hereby incorporated into this Detailed Description by this reference, with each claim standing on its own as a separate embodiment of the present disclosure.

Further aspects of the disclosure are provided by the subject matter of the following clauses:

An apparatus to generate an artificial bird for impact testing, the apparatus including a mold generator to form a mold based on a bird class identification, a mold filler to fill the mold with a first layer of crushed ice and a second layer of crushed ice, a compressor to compress an ice surface of at least one of the first layer or the second layer of the crushed ice to form indentations on the ice surface, and a freezer to re-freeze the crushed ice layers inside the mold to form an artificial bird.

The apparatus of any preceding clause, further including a sectioner to section the artificial bird into sections of equal size to determine a density of at least one of the sections.

The apparatus of any preceding clause, wherein the bird class identification includes a bird weight, the bird weight used to determine a total amount of crushed ice used to fill the mold.

The apparatus of any preceding clause, wherein the compressor uses a flat tamper or a cleated tamper to apply one or more compression strokes to the ice surface.

The apparatus of any preceding clause further including a sprayer to mist an ice surface of the first layer with water prior to positioning the second layer of the crushed ice on the first layer of the crushed ice.

The apparatus of any preceding clause further including a controller to control parameters associated with generating the artificial bird, including at least one of a temperature, a number of ice layers, or a number of compression strokes.

A method to generate an artificial bird for impact testing, the method including forming a mold based on a bird class identification, filling the mold with a first layer of crushed ice and a second layer of crushed ice, compressing an ice surface of at least one of the first layer or the second layer of the crushed ice to form indentations on the ice surface, and re-freezing the crushed ice layers inside the mold to form an artificial bird.

The method of any preceding clause, further including sectioning the artificial bird into sections of equal size to determine an ice density of at least one section.

The method of any preceding clause wherein the compressing includes applying compression strokes to the ice to form one or more indentations on a surface of the ice.

The method of any preceding clause wherein the compression strokes are performed using a cleated tamper.

The method of any preceding clause further including misting a surface of the first layer or the second layer of the crushed ice prior to applying a subsequent layer of crushed ice.

The method of any preceding clause further including positioning a velocity target inside the artificial bird.

The method of any preceding clause further including performing a simulated bird ingestion event using artificial bird.

The method of any preceding clause further including determining impact energy release during the simulated bird ingestion event.

The method of any preceding clause wherein the mold is cylindrical.

A method of manufacturing an artificial bird for impact testing, including crushing an amount of ice corresponding to a desired artificial bird weight, positioning a first layer of crushed ice inside a mold, compressing a top of the first layer of the crushed ice, moistening the compressed top of the first layer, and positioning a second layer of crushed ice on the first layer.

The method of any preceding clause further including refreezing the crushed ice inside the mold to form the artificial bird.

The method of any preceding clause wherein the artificial bird is of uniform density.

The method of any preceding clause wherein the compressing is performed using a flat tamper followed by a cleated tamper.

The method of any preceding clause wherein parameters associated with generating the artificial bird are controlled during the bird formation, including at least one of a temperature, a number of ice layers, or a number of compression strokes.

What is claimed is:

1. A method to generate an artificial bird for impact testing, the method comprising:

forming a mold based on a bird class identification;

filling the mold with a first layer of crushed ice;

compressing an ice surface of the first layer of crushed ice to form indentations on the ice surface;

positioning a second layer of crushed ice on the first layer such that the first layer of crushed ice and the second layer of crushed ice are bonded with a bonding strength;

misting a surface of the second layer of crushed ice, a distribution of the misting based on the bonding strength between the first layer of crushed ice and the second layer of crushed ice;

re-freezing the first layer of crushed ice and the second layer of crushed ice inside the mold to form an artificial bird;

sectioning the artificial bird, the sectioning performed using one or more blocks positioned to prevent melting of the artificial bird; and mounting the artificial bird on a sabot, the artificial bird wrapped in a material preventing adhesion of the artificial bird to the sabot.

2. The method of claim 1, wherein the sectioning includes sectioning the artificial bird into sections of equal size to determine an ice density of at least one section.

3. The method of claim 1, wherein the compressing includes applying compression strokes to form one or more indentations on the ice surface.

4. The method of claim 3, wherein the compression strokes are performed using a cleated tamper.

5. The method of claim 1, further including misting a surface of the first layer or the second layer of crushed ice prior to applying a subsequent layer of crushed ice.

6. The method of claim 1, further including tracking a velocity of the artificial bird using a paper target positioned within the artificial bird.

7. The method of claim 1, further including performing a simulated bird ingestion event using the artificial bird.

8. The method of claim 7, further including determining impact energy release during the simulated bird ingestion event.

9. The method of claim 1, wherein the mold is cylindrical.

10. A method of manufacturing an artificial bird for impact testing, comprising:

crushing an amount of ice corresponding to a desired artificial bird weight;

positioning a first layer of crushed ice inside a mold;

compressing a top of the first layer of crushed ice;

moistening the compressed top of the first layer;

positioning a second layer of crushed ice on the first layer such that the first layer of crushed ice and the second layer of crushed ice are bonded with a bonding strength;

misting a surface of the second layer of crushed ice, a distribution of the misting based on the bonding strength between the first layer of crushed ice and the second layer of crushed ice;

sectioning the artificial bird, the sectioning performed using one or more blocks positioned to prevent melting of the artificial bird; and mounting the artificial bird on a sabot, the artificial bird wrapped in a material preventing adhesion of the artificial bird to the sabot.

11. The method of manufacturing of claim 10, further including refreezing the first and second layers of crushed ice inside the mold to form the artificial bird.

12. The method of manufacturing of claim 10, wherein the artificial bird is of uniform density.

13. The method of manufacturing of claim 10, wherein the compressing is performed using a flat tamper followed by a cleated tamper.

14. The method of manufacturing of claim 10, wherein parameters associated with manufacturing the artificial bird are controlled during the manufacturing of the artificial bird, including at least one of a temperature, a number of ice layers, or a number of compression strokes.

* * * * *